US011235357B2

(12) United States Patent
Chiang

(10) Patent No.: US 11,235,357 B2
(45) Date of Patent: Feb. 1, 2022

(54) SPRAY GUN CLEANER

(71) Applicant: Bendel Werkzeuge GmbH & Co. KG, Bad Bevensen (DE)

(72) Inventor: Lan-fen Chiang, Keelung (TW)

(73) Assignee: BENDEL WERKZEUGE GMBH & CO. KG, Bad Bevensen (DE)

( * ) Notice: Subject to any disclaimer, the term of this patent is extended or adjusted under 35 U.S.C. 154(b) by 0 days.

(21) Appl. No.: 16/067,544

(22) PCT Filed: Nov. 24, 2016

(86) PCT No.: PCT/EP2016/078709

§ 371 (c)(1),
(2) Date: Jun. 29, 2018

(87) PCT Pub. No.: WO2017/017286

PCT Pub. Date: Feb. 2, 2017

(65) Prior Publication Data

US 2018/0304314 A1 Oct. 25, 2018

(30) Foreign Application Priority Data

Dec. 30, 2015 (TW) ..... 104221184
Jun. 30, 2016 (TW) ..... 105209836

(51) Int. Cl.
*B08B 3/02* (2006.01)
*B01F 5/04* (2006.01)
(Continued)

(52) U.S. Cl.
CPC ..... *B08B 3/028* (2013.01); *B01F 5/043* (2013.01); *B01F 5/0496* (2013.01); *B05B 3/06* (2013.01);
(Continued)

(58) Field of Classification Search
CPC . B08B 3/028; B08B 5/02; B01F 5/043; B01F 5/0496; B05B 3/06; B05B 7/0646;
(Continued)

(56) References Cited

U.S. PATENT DOCUMENTS 2,270,579 A * 1/1942 Chamberlin ..... A47L 1/02 15/321
4,371,282 A * 2/1983 Sturm ..... B25G 3/10 403/277
(Continued)

FOREIGN PATENT DOCUMENTS

DE 102010034921 A1 2/2012
DE 202013105041 U1 1/2014
EP 1857190 A1 11/2007

OTHER PUBLICATIONS

International Search Report dated Mar. 2, 2017, in International PCT Patent Application No. PCT/EP2016/078709, filed Nov. 24, 2016 (5pgs).
(Continued)

*Primary Examiner* — Tuongminh N Pham
(74) *Attorney, Agent, or Firm* — North Weber & Baugh LLP; Michael North

(57) ABSTRACT

A pneumatic cleaning gun according to the present invention comprises a gun housing with a compressed air connection, a liquid nozzle with a nozzle cover, and an air intake tube which leads into the covered flow channel and can also be connected to a suction device via a suction hose in order to suction dirt particles through the flow channel. The cleaning gun is configured such that the air intake tube is not rigidly but pivotably mounted on the cleaning gun. The air intake tube can therefore be mounted in a plurality of different positions of use such that the user can find the most comfortable or convenient position of use and the air intake tube can be correspondingly adjusted.

9 Claims, 18 Drawing Sheets

(51) Int. Cl.

| | |
|---|---|
| ***B05B 7/24*** | (2006.01) |
| ***B05B 3/06*** | (2006.01) |
| ***B05B 7/06*** | (2006.01) |
| ***B08B 5/02*** | (2006.01) |
| *B05B 14/30* | (2018.01) |

(52) U.S. Cl.
CPC ..... *B05B 7/064* (2013.01); *B05B 7/2435* (2013.01); *B08B 5/02* (2013.01); *B05B 14/30* (2018.02)

(58) Field of Classification Search
CPC .... B05B 7/2435; B05B 14/30; F16L 27/0927; F16L 37/091; F16L 33/035; F16L 37/02; F16L 37/04
See application file for complete search history.

(56) References Cited

U.S. PATENT DOCUMENTS

| | | | | |
|---|---|---|---|---|
| 4,646,480 | A * | 3/1987 | Williams | B24C 3/065 451/102 |
| 6,450,422 | B1 * | 9/2002 | Maggio | B05B 7/0483 239/345 |
| 2015/0000705 | A1 * | 1/2015 | Dehn | B08B 5/02 134/21 |

OTHER PUBLICATIONS

Written Opinion dated Mar. 2, 2017, in International PCT Patent Application No. PCT/EP2016/078709, filed Nov. 24, 2016 (7pgs).
International Preliminary Examination Report dated Mar. 16, 2018, in International PCT Patent Application No. PCT/EP2016/078709, filed Nov. 24, 2016 (19pgs).

* cited by examiner

SPRAY GUN CLEANER

CROSS-REFERENCE TO RELATED APPLICATIONS

This application is a US National Stage application filed under 35 U.S.C. 371, of International Patent Application No. PCT/EP2016/078709, entitled, "PNEUMATIC CLEANING GUN," naming Lan-fen Chiang as inventor, and filed Nov. 24, 2016, claiming priority of Taiwan Patent Application No. 104221184, filed Dec. 30, 2015, and Taiwan Patent Application No. 105209836, filed Jun. 30, 2016, which applications are hereby incorporated herein by reference in their entireties.

The present invention relates to a cleaning gun, in particular to a pneumatic cleaning gun.

As quality of life has increased with respect to clothing, food, housing, travel, and leisure, every household has come to have a vehicle such as a passenger car, saloon car, or the like. When the vehicle travels along the streets, it is nearly impossible to prevent grime such as sandy loam or dusty dirt from sticking thereto. The vehicle therefore, after having been driven for a certain length of time, needs to be cleaned and washed off in order to maintain the cleanliness of the vehicle. Many vehicle owners therefore use a day off to bring their vehicle to a car wash for cleaning. When the member of personnel carries out the cleaning work on the vehicle, first the cleaning agent is applied to the vehicle and rubbed with a sponge, following which the cleaning foam is rinsed off with water from a hose. The water pressure from the water hose is often insufficient, a consequence of which is that the dusty dirt is not easily washed off the vehicle such that it is left clean, and remnants of grime, such as dusty dirt and sandy loam, remain on the vehicle.

Experts have therefore developed a pneumatic spray cleaning gun with a rotation mechanism. The pneumatic spray cleaning gun with rotation mechanism uses high-pressure air to suction the liquid in the interior of the liquid container through the liquid removal hose such that the liquid mixes with the high-pressure air and continues through the nozzle to be sprayed out to the exterior. This increases the cleaning capacity of the vehicle.

Experts have also developed a pneumatic spray cleaning gun with a rotation mechanism with dust suction ability. Apart from an air inlet opening for spraying the air and a liquid inlet opening for spraying the liquid, the pneumatic spray cleaning gun with rotation mechanism with dust suction ability also has an air intake opening for suctioning in the dust. Since the air inlet opening, the liquid inlet opening, and the air intake opening all consequently require an external connecting hose in order to be connected to the container that provides the air or the liquid, the number of openings to be joined together is greater, without having to change the composition of the external connecting hoses. One of the problems addressed by the developers is therefore that of being able to make the composition of the pneumatic spray cleaning gun with rotation mechanism with external connecting hoses more practical.

The novelty of the invention is in providing a pneumatic cleaning gun that offers more practical assembly between the pneumatic spray cleaning gun with rotation mechanism and the external connecting hoses.

A pneumatic cleaning gun according to the present invention comprises a gun housing with a compressed air connection, a liquid nozzle with a nozzle cover, and an air intake tube which leads into the covered flow channel and can also be connected to a suction device via a suction hose in order to suction dirt particles through the flow channel.

Depending on the use of the cleaning gun, the suction hose may interfere with work if the suction hose hinders the intended cleaning work.

This disadvantage is eliminated by the invention by the fact that the cleaning gun is improved such that the air intake tube is not rigidly but pivotably mounted on the cleaning gun. The air intake tube can therefore be mounted in a plurality of different positions of use such that the user can find the most comfortable or convenient position of use and the air intake tube can be correspondingly adjusted.

The pneumatic cleaning gun that is disclosed in one embodiment comprises a gun housing, a nozzle cover, and an air intake tube. The gun housing comprises a gun body and a liquid nozzle. The liquid nozzle is connected to the gun body. The nozzle cover comprises a mounting sleeve and a cover sleeve. The mounting sleeve is attached to the gun body of the gun housing. The cover sleeve is rotatably attached to the mounting sleeve and surrounds the covered flow channel; moreover, the liquid nozzle is located in the interior of the covered flow channel of the cover sleeve. The air intake tube is rigidly connected to the cover sleeve. The air intake tube has an air intake opening. The air intake opening leads into the covered flow channel. The mounting sleeve then comprises a plurality of first positioning structures. The cover sleeve has a second positioning structure. The cover sleeve can rotate relative to the mounting sleeve. In addition, the second positioning structure may optionally engage with one of the first positioning structures, such that the air intake tube has a plurality of positions of use.

The pneumatic cleaning gun according to the embodiment above is divided by the nozzle cover into two sections. One section is a rigidly fastened mounting sleeve, the other section is a rotatable cover sleeve. The latter can be connected to the air intake tube of the cover sleeve and rotated to the required position of rotation, depending on the manner of mounting preferred by the user. As a result, not only can the mounting of the air intake tube onto the cleaning gun be made more practical, but disruption of the cleaning process by the air intake tube can be much better prevented.

The pneumatic cleaning gun that is disclosed in another embodiment comprises a gun housing, a nozzle cover, and a rotary connection tube. The gun housing comprises a gun body, a hand grip, and a liquid nozzle. The hand grip and the liquid nozzle are respectively connected to the two opposite sides of the gun body. The nozzle cover is attached to the gun body of the gun housing. A cover cavity is located around the nozzle cover, and the liquid nozzle is located in the interior of the cover cavity of the nozzle cover. The rotary connection tube is connected to the nozzle cover. The rotary connection tube has an air intake opening. The air intake opening leads to the cover cavity. The rotary connection tube may then rotate relative to the gun housing and has at least one first position of use and one second position of use.

The pneumatic cleaning gun according to the last-mentioned embodiment illustrates a rotary connection tube that can be rotated relative to the connecting pieces. The rotary connection tube can be rotated into the position preferred by the user and then assembled together with the external connection channels.

The above explanations of the invention and the explanations of the following embodiments serve to demonstrate and explain the principal of the invention. They also offer further explanations as to the scope of the patent application.

DETAILED DESCRIPTION OF THE EMBODIMENTS

Figure 1:
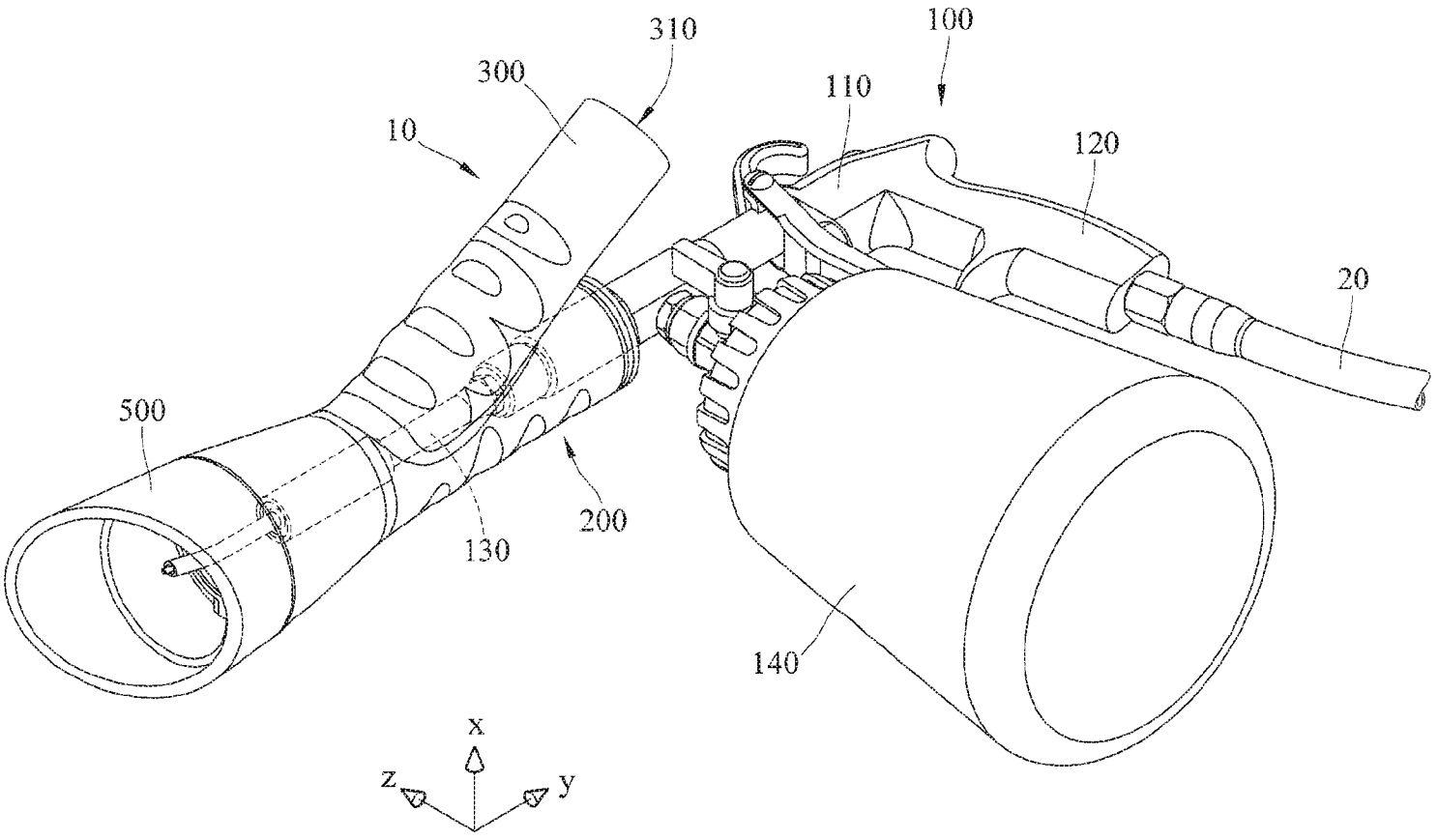
FIG. 1: is a three-dimensional view of the pneumatic cleaning gun according to the first embodiment of the invention.
Figure 2:
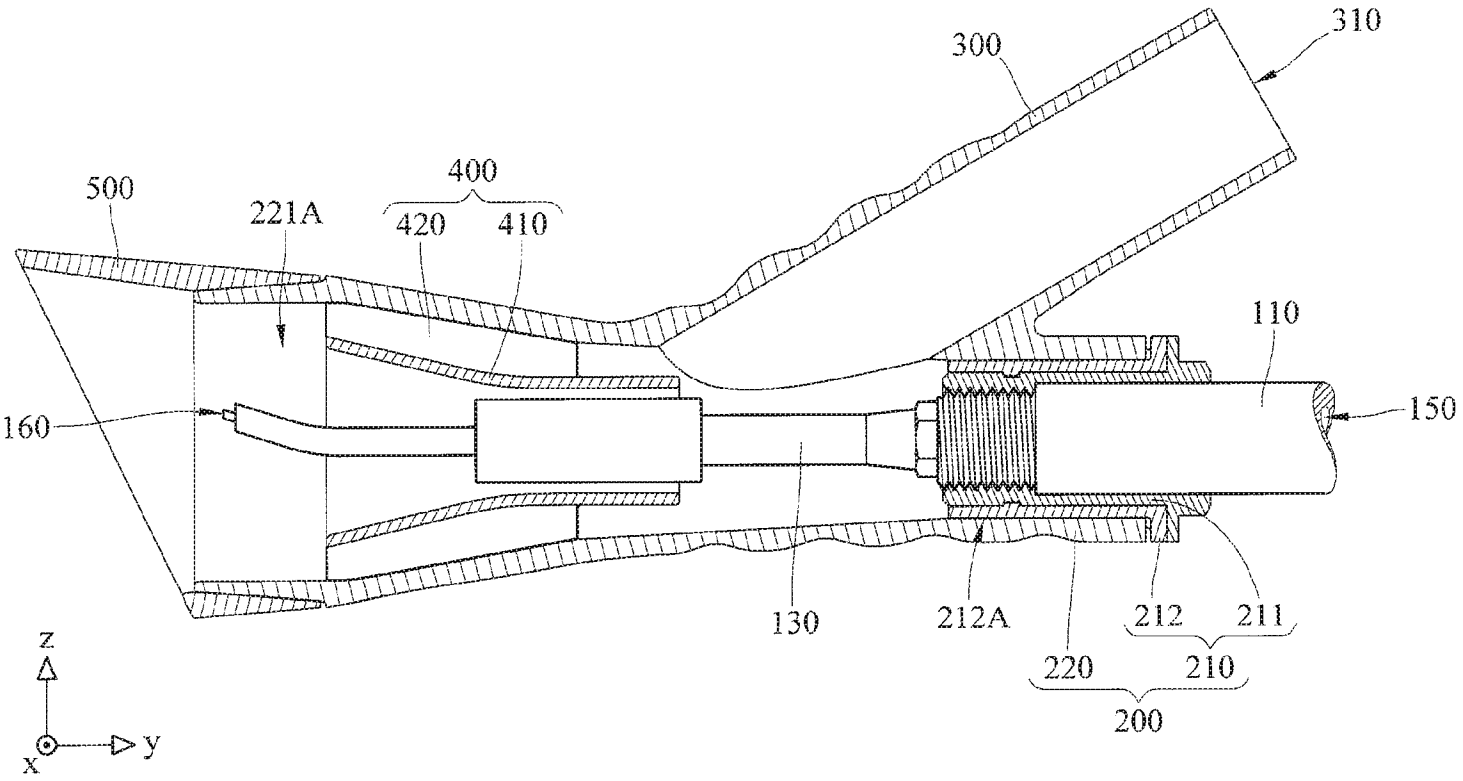
FIG. 2: is a sectional view of FIG. 1.

See FIGS. 1 and 2. FIG. 1 is a three-dimensional view of the pneumatic cleaning gun according to the first embodiment of the invention. FIG. 2 is a sectional view of FIG. 1.

The pneumatic cleaning gun 10 of the first embodiment comprises a gun housing 100, a nozzle cover 200, and an air intake tube 300. The pneumatic cleaning gun 10 from this embodiment also comprises a flow disruption ring 400 and a deflection ring 500.

The gun housing 100 comprises a gun body 110, a hand grip 120, a liquid nozzle 130, and a liquid container 140. The hand grip 120 and the liquid nozzle 130 are connected to the gun body 110 on opposite sides thereof. The direction of extension of the hand grip 120 crosses the direction of extension of the gun body 110. If the liquid nozzle 130 has, for example, a curved shape, then the direction of extension of the liquid nozzle 130 runs parallel to the direction of extension of the gun body 110. The liquid container 140 is connected to the gun body 110 and is used to store water or cleaning fluid. It should be noted that, in this embodiment, the liquid nozzle 130 has a curved shape so that the centrifugal force can act to enhance the cleaning effect of the pneumatic cleaning gun 10. The shape thereof is not, however, limited thereto, and in other embodiments the liquid nozzle 130 may also take a rectilinear shape.

More specifically, the gun housing 100 has an air channel 150 and a liquid hose 160. The air channel 150 extends from the end of the hand grip 120 of the gun housing 100 facing away from the gun body 110 to the end of the liquid nozzle 130 facing away from the gun body 110. The hand grip 120 is used as a plug-in connection for a compressed air line 20, and the compressed air line 20 is connected to the air channel 150. The compressed air line 20 is connected to a compressed air device (not shown) The liquid hose 160 extends from the interior of the liquid container 140 to the end of the liquid nozzle 130 facing away from the gun body 110. This means that the liquid hose 160 lies partially outside of the air hose 150. The liquid hose 160 also lies partially inside the air channel 150, and extends from the gun body 110 to the liquid nozzle 130.

When the compressed air device is activated, the high-pressure air generated by the compressed air device is used to pass through the air channel 150 and is sprayed out by the liquid nozzle 130. The high-pressure air can also produce a lifting action, and suction the liquid in the interior of the liquid container 140, which then flows through the liquid hose 160 and is sprayed out through the liquid nozzle 130.

Figure 3:
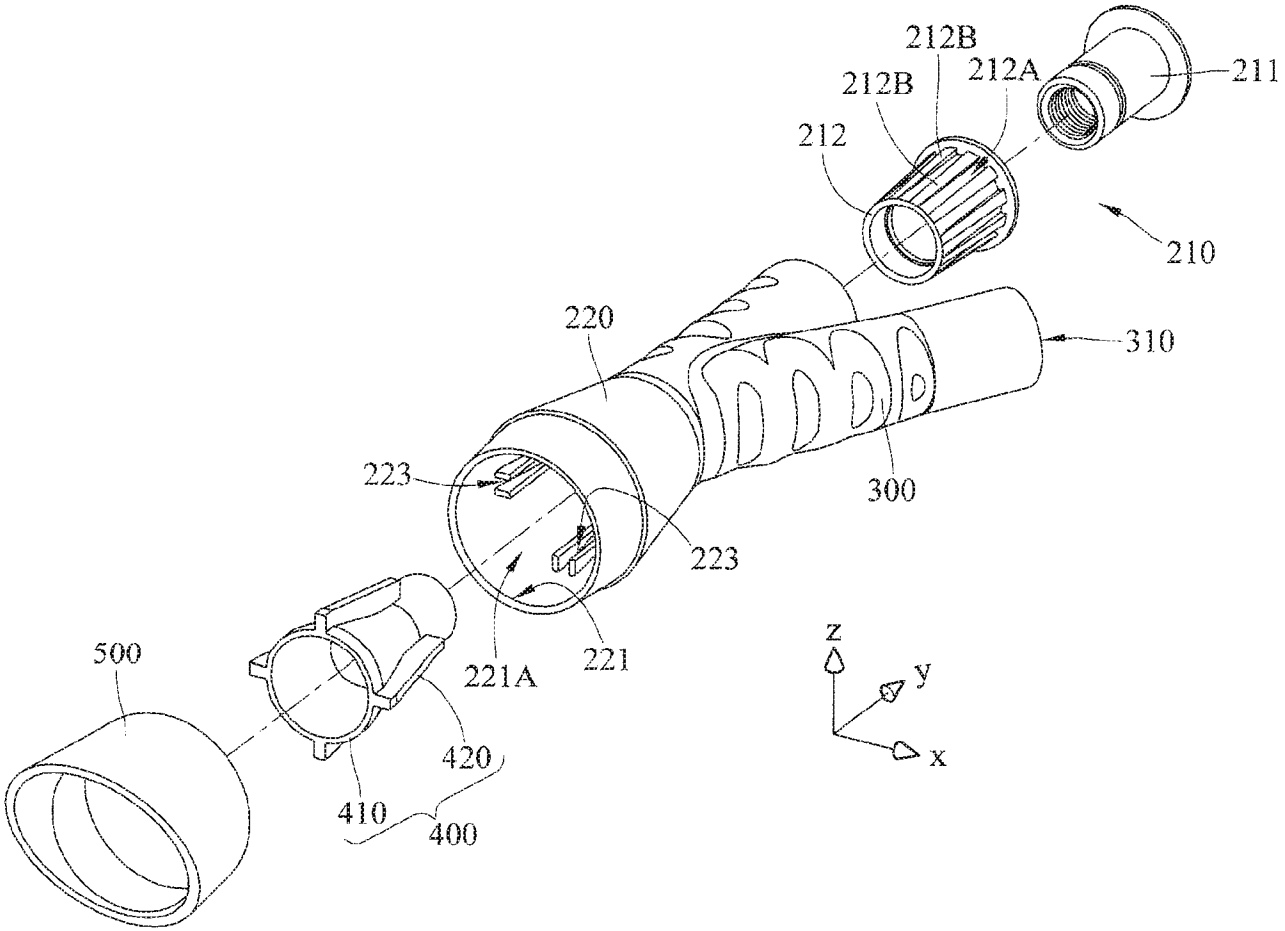
FIG. 3: shows a detail from FIG. 1.
Figure 4:
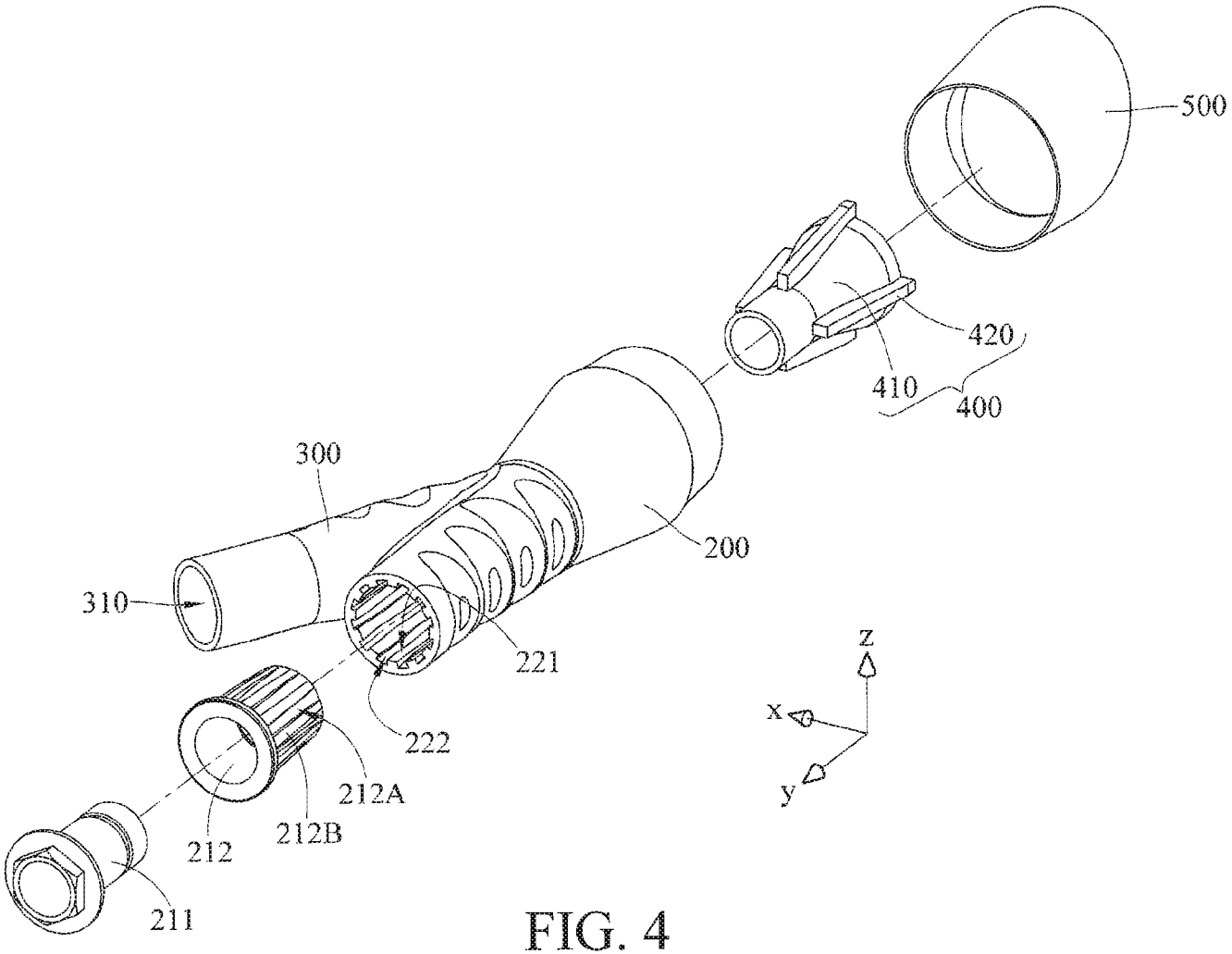
FIG. 4: shows a detail from another angle of FIG. 2.

See FIGS. 3 and 4. FIG. 3 shows a detail from FIG. 1. FIG. 4 shows a detail from FIG. 2 from a different angle.

The nozzle cover 200 comprises a mounting sleeve 210 and a cover sleeve 220. The mounting sleeve 210 is attached to the gun body 110 of the gun housing 100. The cover sleeve 220 is attached to the mounting sleeve 210 so as to be rotatable. In this embodiment, the mounting sleeve 210 comprises an inner mounting ring 211 and an outer mounting ring 212. The inner mounting ring 211 is screwed onto the gun body 110. The outer mounting ring 212 is drawn over the inner mounting ring 211 and engages therewith. The outer mounting ring 212 has an outer surface 212A and a plurality of first positioning structures 212B. These first positioning structures 212B are, for example, a plurality of raised ribs that are located on the outer surface 212A. The height of these raised ribs by which the raised ribs extend over the outer surface 212A also increases gradually from the side that faces the cover sleeve to the side that faces away from the cover sleeve.

The cover sleeve 220 has an inner side 221, a plurality of second positioning structures 222, and a plurality of engaging grooves 223. The inner side 221 surrounds the covered flow channel 221A, and the liquid nozzle 130 is located in the interior of the flow channel 221A of the cover sleeve 220. These second positioning structures 222 and these engaging grooves 223 are located on the inner side 221. The second positioning structures 222 are also a plurality of concave grooves that can each separately engage with the first positioning structures 212B in order to position the cover sleeve 220 in the rotation position.

In this embodiment, there are a plurality of second positioning structures 222. The shape is not limited thereto, however, and in other embodiments it would also be possible to have only one single second positioning structure 222, and this second positioning structure may optionally engage with one of the first positioning structures.

One end of the air intake tube 300 is rigidly connected to the cover sleeve 220. The other end of the air intake tube 300 has an air intake opening 310, and the air intake opening 310 leads into the covered flow channel 221A. Since one end of the air intake tube 300 is rigidly connected to the cover sleeve 220, the air intake tube 300 can be moved together with the cover sleeve 220 and rotate relative to the mounting sleeve 210. This contributes to the air intake tube 300 having a plurality of positions of use.

The air intake opening 310 is also used to plug in an air intake hose 30, wherein the air intake hose 30 is connected to an air suction apparatus (not shown). If the air suction apparatus is put into operation, the air suction apparatus can suction out contaminants in the interior of the covered flow channel 221A in order to further increase the cleaning effect of the pneumatic cleaning gun 10.

The flow disruption ring 400 is attached to the cover sleeve 220 and is located on the covered flow channel 221A.

More specifically, the flow disruption ring 400 comprises a ring 410 and a plurality of flow disruption plates 420. The ring 410 is located in the interior of the covered flow channel 221A, and, in this case, is separated from the cover sleeve 220. The flow disruption plates 420 extend beyond the ring 410 and each engage with the engaging grooves 223 of the cover sleeve 220.

The deflection ring 500 is removably attached to the end of the cover sleeve 220 that faces away from the mounting sleeve 210. It should be noted that in other embodiments, the deflection sleeve 500 may also form a single body together with the cover sleeve 220.

Instead of the removable deflection ring 500 that is depicted, differently shaped front nozzles may also be placed on the cover sleeve 220. In particular, the front nozzle may be equipped with a brush ring that can act mechanically on the dirt to be cleared out during the work with the cleaning gun. The front nozzle may also play a role in loosening dirt fibers, as is known with conventional carpet cleaners. The front nozzle may also have an elongated design in order to thus reach the dirt in gaps and narrow depressions that are difficult to reach and suction same out. Finally, the front nozzle may be provided, at the perimeter of the outer opening thereof, with a plurality of lateral recesses that are used to allow air to enter laterally when the front nozzle is in place, so that the nozzle is not fastened by suction due to the vacuum effect, but rather the incoming air can continue to remove dirt particles. Such a toothed front nozzle may have a wave-shaped rim, or may be shaped like a saw blade. Such measures advantageously facilitate suction.

Figure 5:
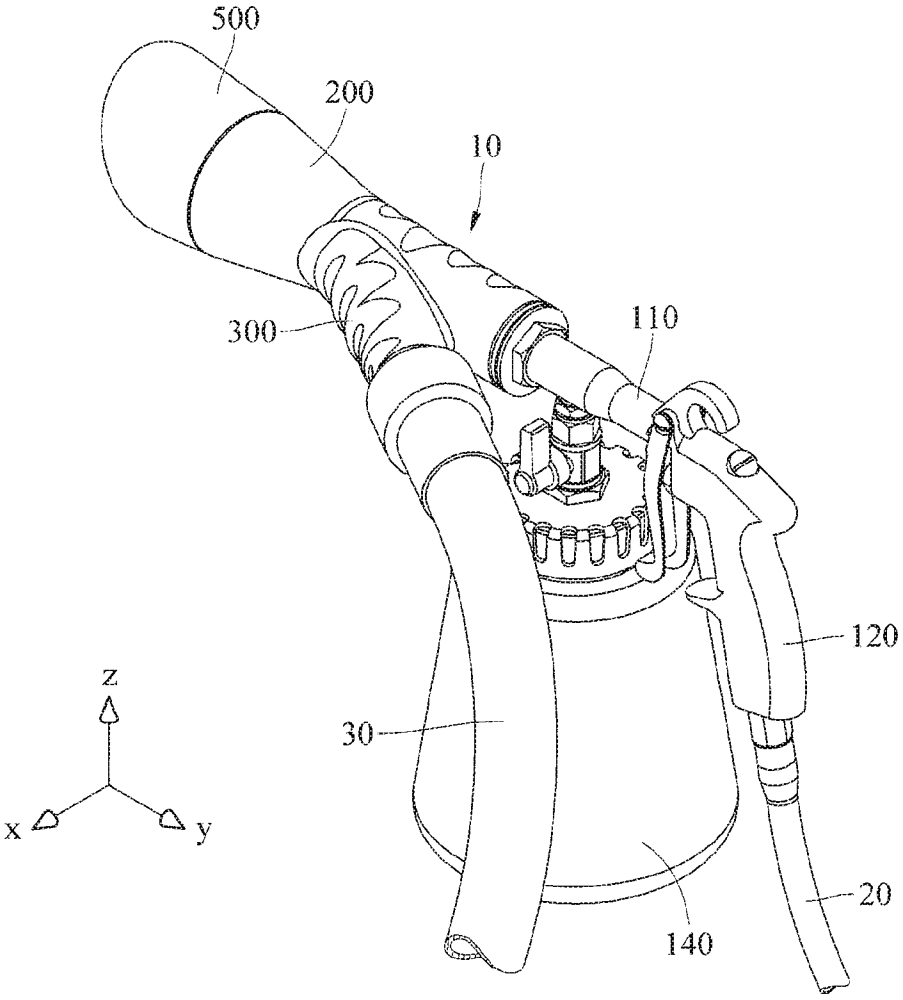
FIG. 5: is a view of the first position of use of the pneumatic cleaning gun from FIG. 1.
Figure 6:
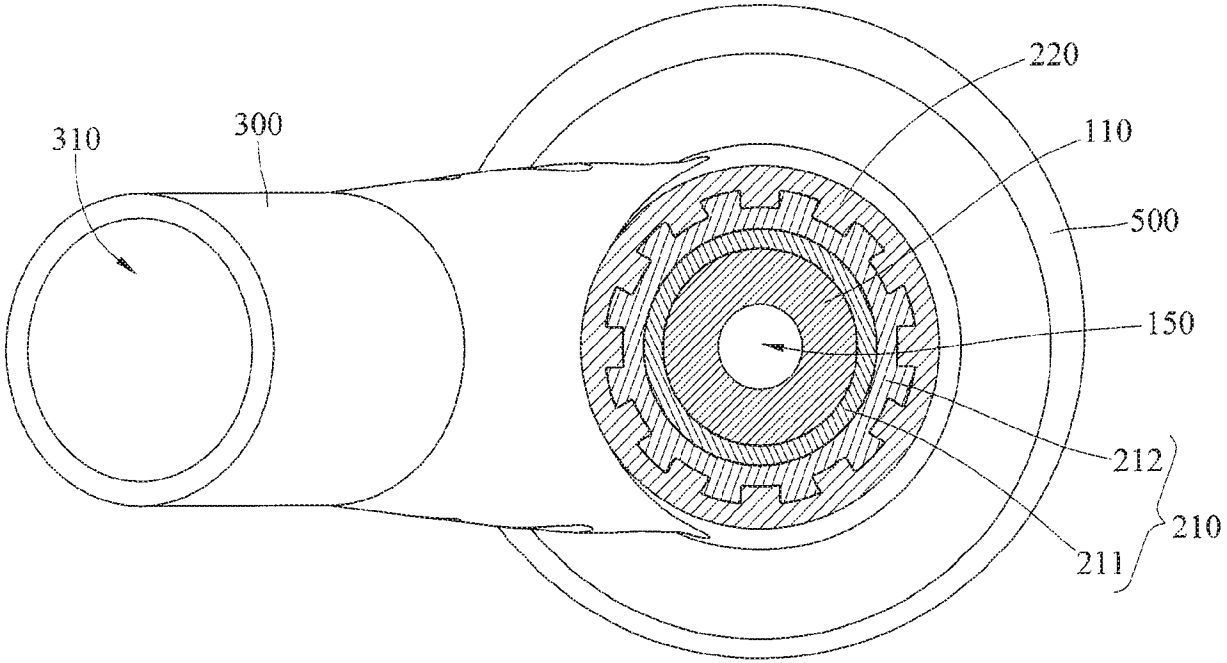
FIG. 6: is a sectional view of FIG. 5.
Figure 7:
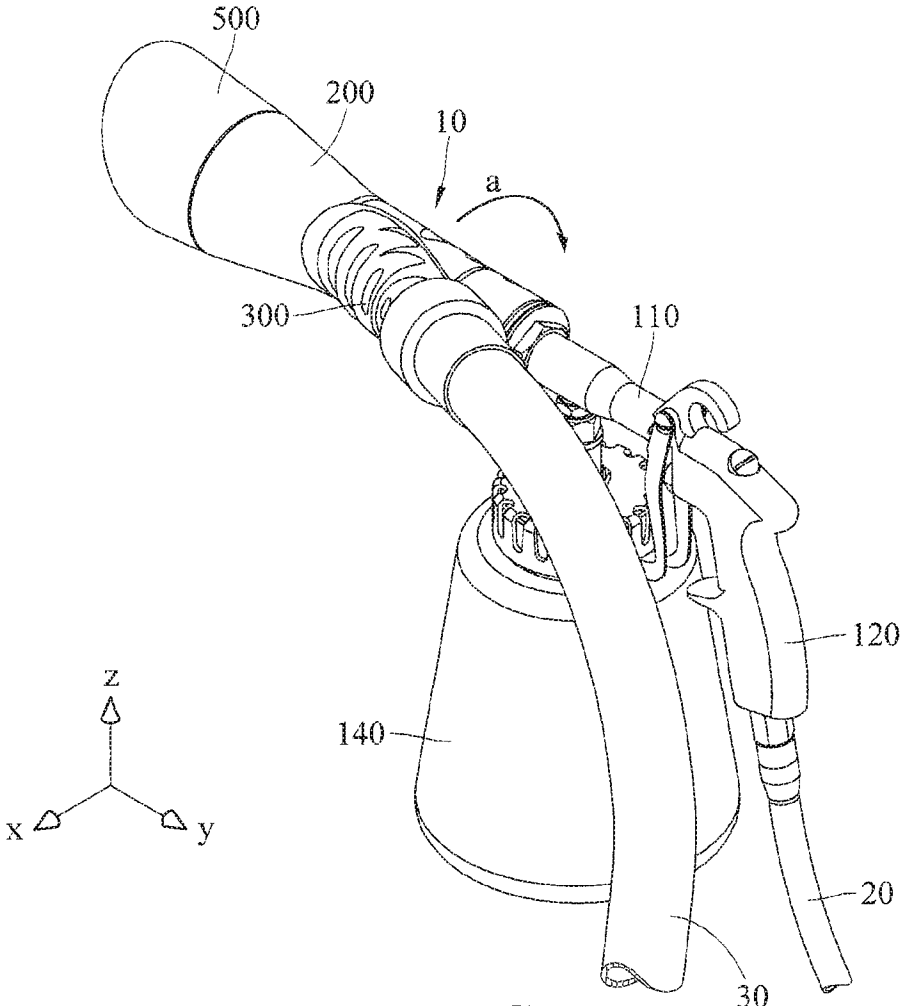
FIG. 7: is a view of the second position of use of the pneumatic cleaning gun from FIG. 1.
Figure 8:
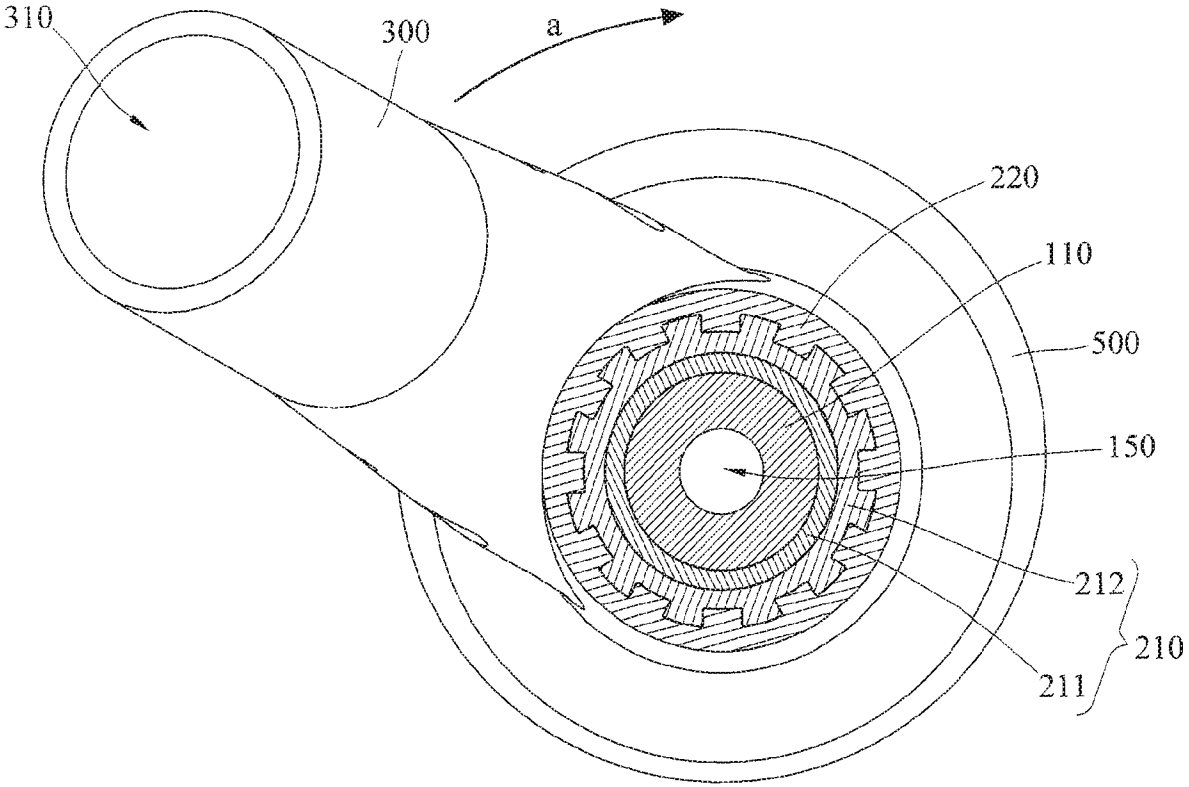
FIG. 8: is a sectional view of FIG. 7.

See FIGS. 5 to 8. FIG. 5 is a view of the first position of use of the pneumatic cleaning gun from FIG. 1. FIG. 6 is a sectional view of FIG. 5. FIG. 7 is a view of the second position of use of the pneumatic cleaning gun 10 from FIG. 1. FIG. 8 is a sectional view of FIG. 7.

If the air suction apparatus is located to the left of the user, the air intake hose 30, which connects the air suction apparatus to the pneumatic cleaning gun 10, is then located on the left side of the pneumatic cleaning gun 10. In order to make use and assembly more practical, the cover sleeve 220 may be rotated to the left side of the gun body, as is depicted in FIGS. 5 and 6. This not only makes it even easier to mount the air intake hose 30 onto the air intake tube 300 of the pneumatic cleaning gun 10, but also prevents the air intake hose 30 from being disruptive for the user during the cleaning process.

Should, however, the air intake hose 30 still have a disruptive effect on the user or the object to be cleaned during the cleaning process, then the user can rotate the cover sleeve 220 in the direction depicted by arrow a in order to easily correct the angle of rotation of the cover sleeve 220 and avoid interference from the air intake hose 30.

The above procedure makes it clear that, by means of the cover sleeve 220 that can be rotated relative to, it is possible to rotate into the position preferred by the user in order to mount the air intake hose 30. This makes it more practical to mount the air intake hose 30 onto the pneumatic cleaning gun 10.

With the pneumatic cleaning gun 10 according to the embodiment above, the nozzle cover 200 can be separated into two parts, wherein one part is the rigidly-fastened mounting sleeve 210 and the other part is the rotatable cover sleeve 220. This makes it possible to rotate the air intake tube 300, which is connected to the cover sleeve 220, to the required rotational position in the manner of mounting preferred by the user. This not only makes it more practical to mount the air intake hose 30 onto the pneumatic cleaning gun 10, but also prevents the air intake hose 30 from being disruptive for the user during the cleaning process.

Figure 9:
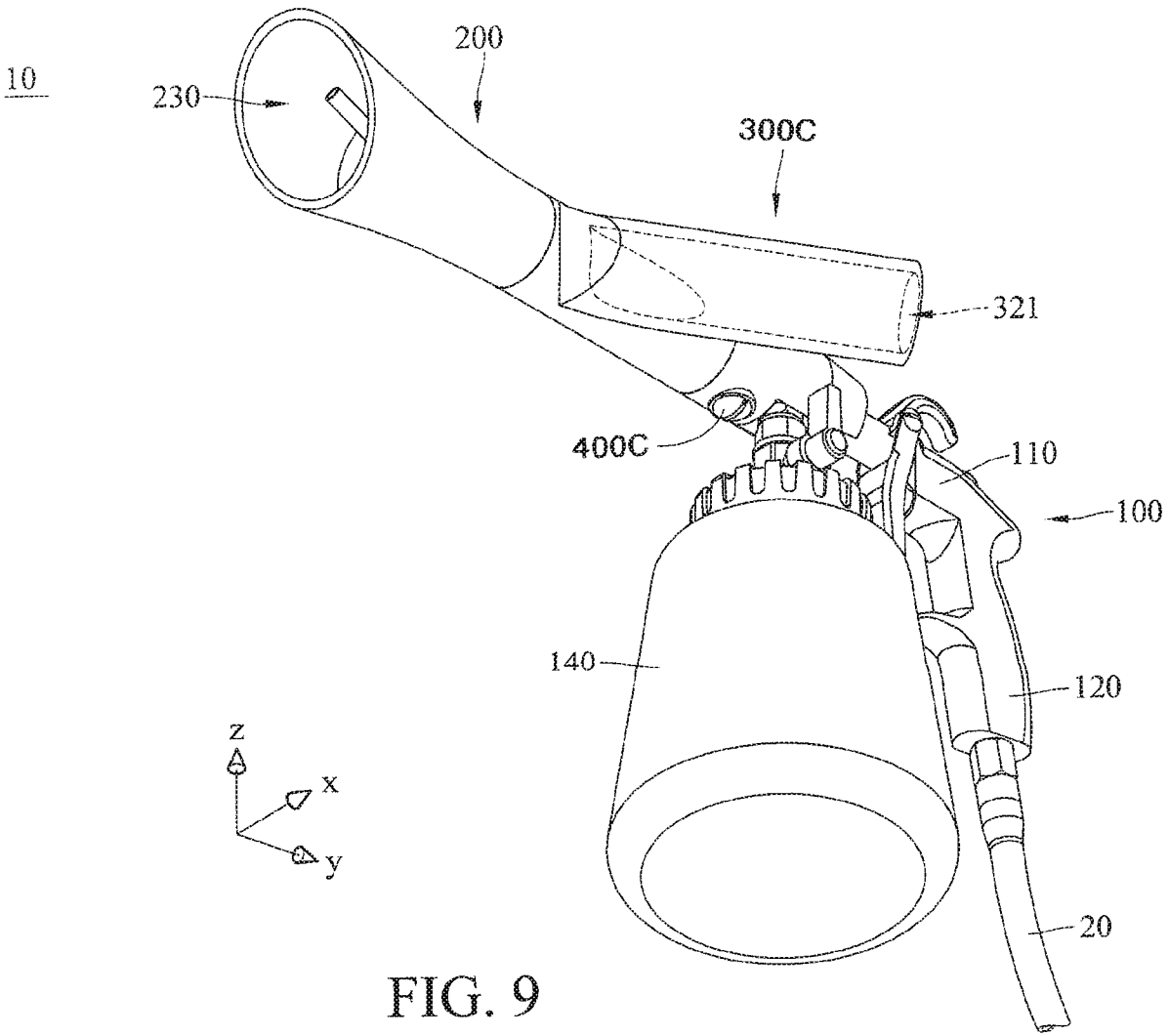
FIG. 9: is a three-dimensional view of the pneumatic cleaning gun according to the first embodiment of the invention.
Figure 10:
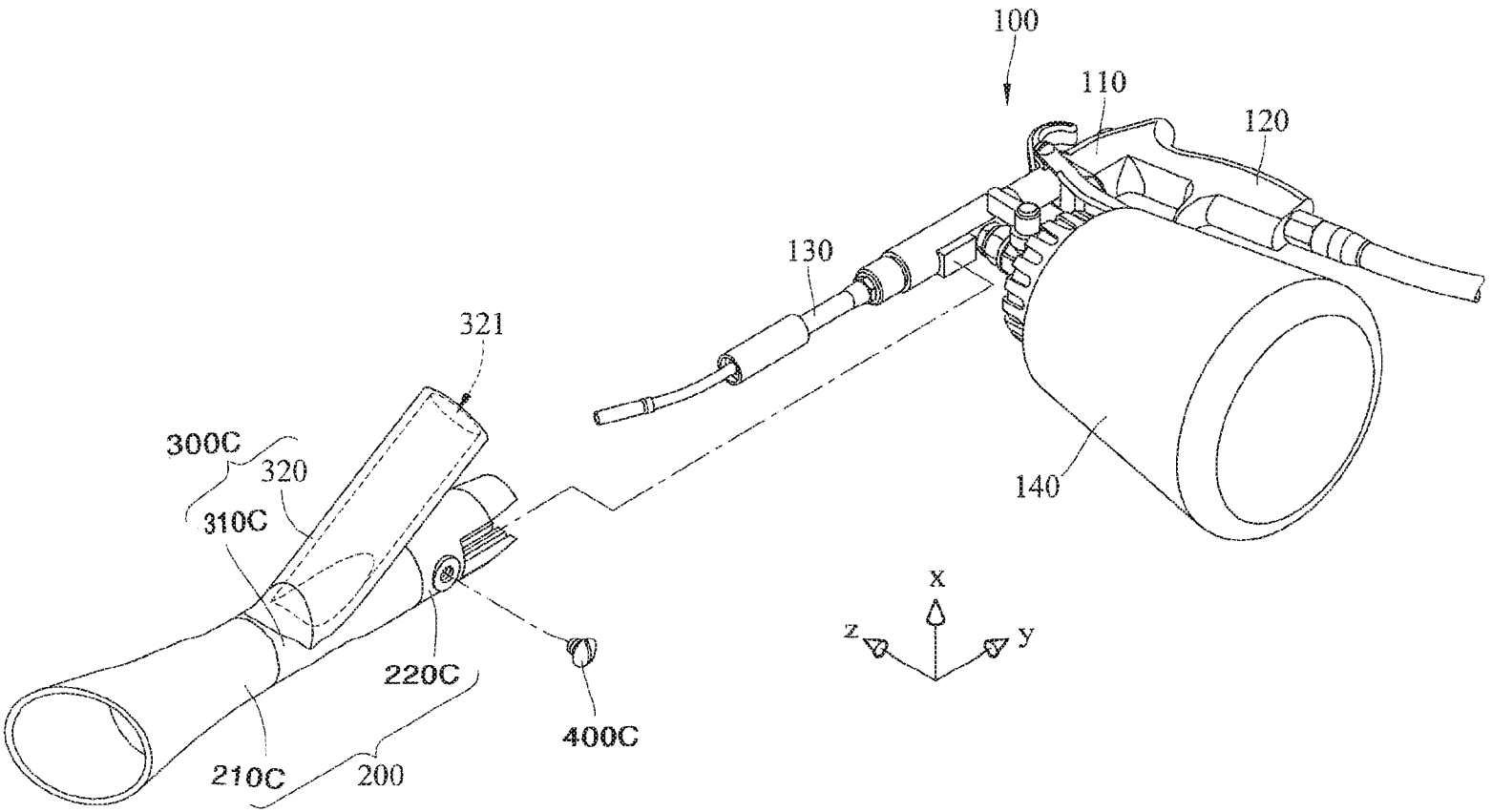
FIG. 10: shows a detail from FIG. 9.
Figure 11:
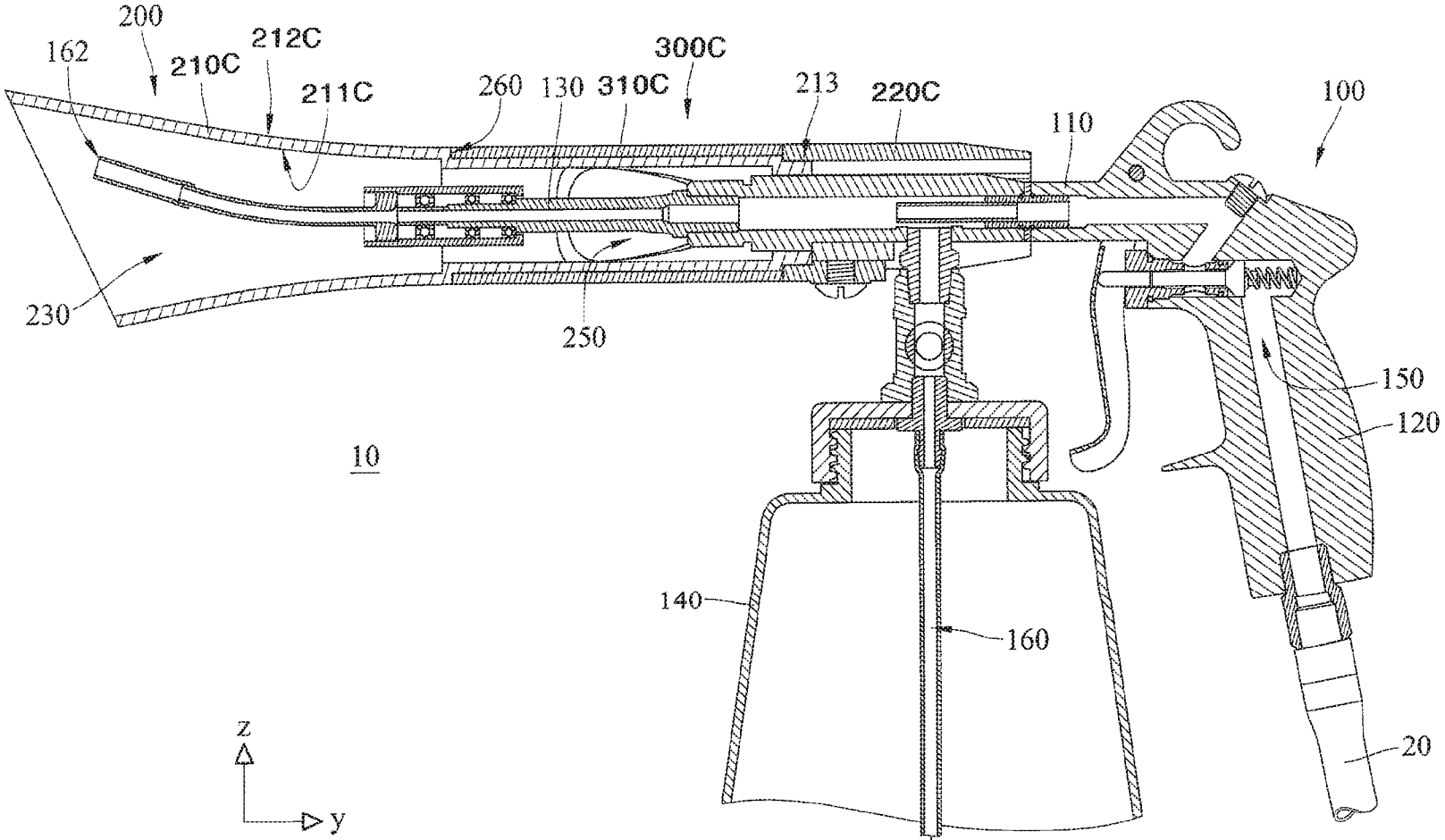
FIG. 11: is a sectional view of FIG. 9.

See FIGS. 9 to 11. FIG. 9 is a three-dimensional view of the pneumatic cleaning gun according to the first embodiment of this invention. FIG. 10 shows a detail from FIG. 9. FIG. 11 is a sectional view of FIG. 9.

The pneumatic cleaning gun 10 of this embodiment comprises a gun housing 100 and a nozzle cover 200 with a rotary connection tube 300C and a fixing piece 400C. The gun housing 100 comprises a gun body 110, a hand grip 120, a liquid nozzle 130, and a liquid container 140. The hand grip 120 and the liquid nozzle 130 are connected to the gun body 100 on opposite sides thereof. The direction of extension of the hand grip 120 crosses the direction of extension of the gun body 110. If the liquid nozzle 130 has, for example, a curved shape, then the direction of extension of the liquid nozzle 130 runs parallel to the direction of extension of the gun body 110. The liquid container 140 is connected to the gun body 110 and is used to store water or cleaning fluid. It should be noted that in this embodiment, the liquid nozzle 130 has a curved shape so that the centrifugal force can act to enhance the cleaning effect of the pneumatic cleaning gun 10. The shape thereof is not, however, limited thereto, and, in other embodiments, the liquid nozzle 130 may also take a rectilinear shape.

More specifically, the gun housing 100 has an air channel 150 and a liquid hose 160. The air channel 150 extends from the end of the hand grip 120 of the gun housing 100 facing away from the gun body 110 to the end of the liquid nozzle 130 facing away from the gun body 110. The hand grip 120 is used as a plug-in connection for a compressed air line 20, and the compressed air line 20 is connected to the air channel 150. The compressed air line 20 is connected to a compressed air device (not shown). The liquid hose 160 has a liquid inlet 161 and a liquid outlet 162. The liquid inlet 161 of the liquid hose 160 is located in the interior of the liquid container 140. The liquid hose 160 also passes through the gun body 110 and is located partially in the interior of the air channel 150. Moreover, the liquid outlet 162 of the liquid hose 160 is located on the end of the liquid nozzle 130 that faces away from the gun body 110. This means that the liquid inlet 161 of the liquid hose 160 is located on the outside of the air channel 150. The liquid hose 160 is also located partially in the interior of the air channel 150, and extends from the gun body 110 to the liquid nozzle 130.

When the compressed air device is activated, the high-pressure air generated by the compressed air device is used to pass through the air channel 150 and is sprayed out by the liquid nozzle 130. The high-pressure air can also produce a lifting action, and suction the liquid in the interior of the liquid container 140, which then flows through the liquid hose 160 and is sprayed out at the liquid outlet 162.

Figure 12:
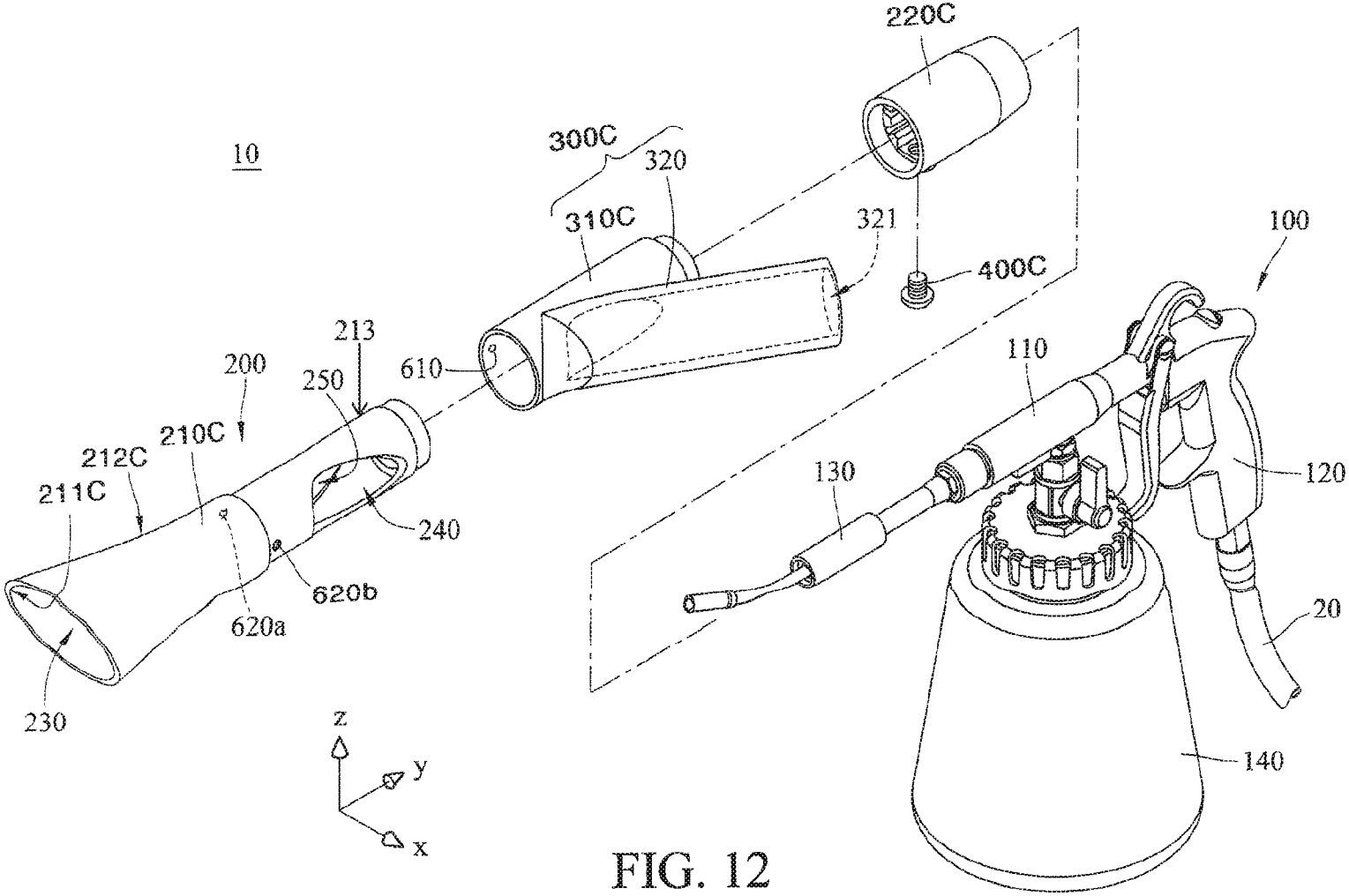
FIG. 12: shows a detail from FIG. 10.
Figure 13:
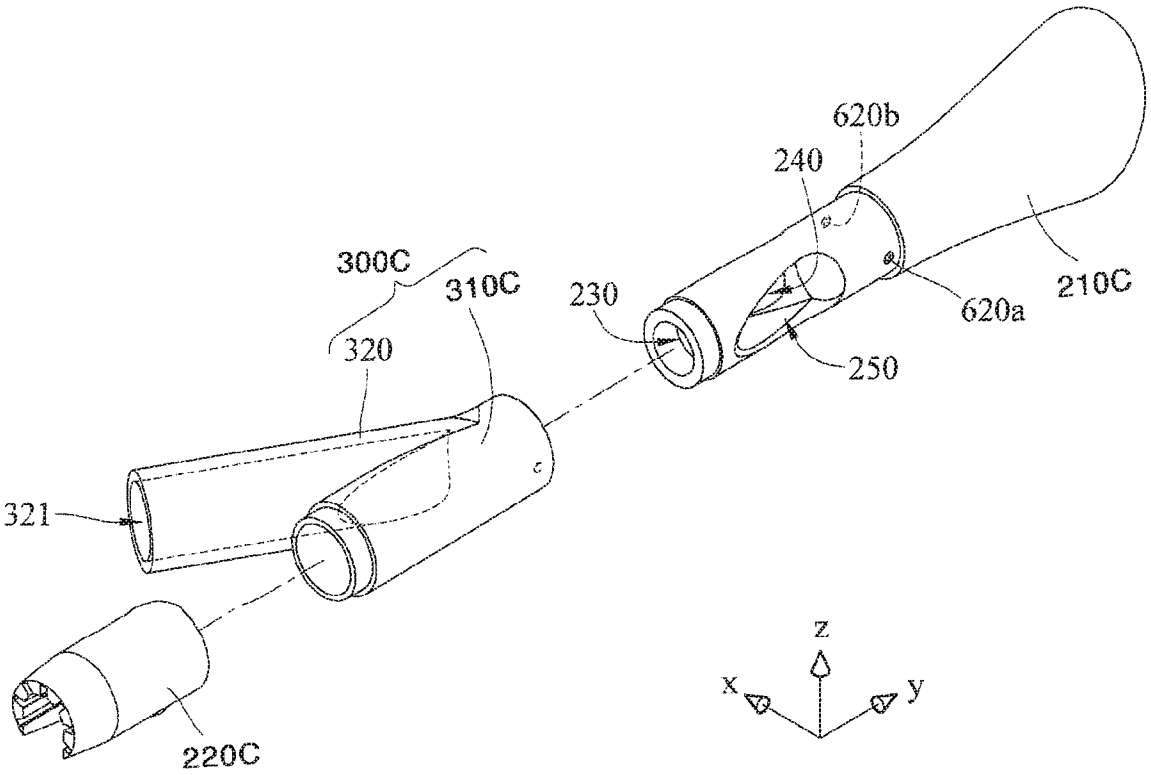
FIG. 13: shows a detail of another angle of the nozzle cover and rotary connection tube from FIG. 12.

See FIGS. 11 to 13. FIG. 12 shows a detail from FIG. 10. FIG. 13 shows a detail of another angle of the nozzle cover 200 with the rotary connection tube 300C from FIG. 12. The nozzle cover 200 is attached to the gun body 110 of the gun housing 100, and also covers the liquid nozzle 130 of the gun housing 100. In a more thorough explanation, the nozzle cover 200 in this embodiment comprises a main body 210C and an annular seat 220C. The main body 210C has an inner surface 211C and outer surface 212C, opposite each other. The inner surface 211C covers the cover cavity 230, and the liquid nozzle 130 is located inside the cover cavity 230 of the nozzle cover 200. One end of the main body 210C has an inwardly recessed hollow 213 of the outer surface 212C (as depicted in FIG. 11). The nozzle cover 200 also has a first opening 240 and a second opening 250, wherein the first opening 240 and the second opening 250 each separately penetrate the main body 210C and are located at opposite sides of the cover cavity 230. The annular seat 220C is drawn over the hollow 213 of the main body 210C, and the main body 210C forms an annular sliding groove 260 together with the annular seat 220C.

The rotary connection tube 300C comprises a plug-in connection ring 310C and a branch tube 320. The branch tube 320 is connected to the plug-in connection ring 310C, and the external shape of the rotary connection tube 300C may be, for example, Y-shaped. The end of the branch tube 320 that faces away from the plug-in connection ring 310C has an air intake opening 321. The rotatable position of the plug-in connection ring 310C is located on the annular sliding groove 260 and makes it possible for the rotary connection tube 300C to occupy a first position of use (see FIG. 14) and a second position of use (see FIG. 15). If the rotary connection tube 300C is located in the first position of use, then the air intake opening 321 of the branch tube 320 penetrates the first opening 240 and leads into the cover cavity 230. If the rotary connection tube 300C is located in the second position of use, then the air intake opening 321 of the branch tube 320 penetrates the second opening 250 and leads into the cover cavity 230. The air intake opening 321 then serves to plug in an air intake hose 30 (see FIG. 14). The air intake hose 30 is connected to an air suction device (not shown). If the air suction apparatus is put into operation, the air suction apparatus can suction out grime in the interior of the cover cavity 230 in order to further enhance the cleaning effect of the pneumatic cleaning gun 10.

In the present embodiment, the pneumatic cleaning gun 10 also has a first positioning device 610 and two second positioning devices 620*a* and 620*b* that are adapted to one another. The first positioning device 610 is located on the inner side of the plug-in connection ring 310C. The two second positioning devices 620*a* and 620*b* are located at the position of the hollow 213 of the main body 210C, i.e., are located on the left and right sides, respectively, of the main body 210C. If the rotary connection tube 300C is located in the first position of use, then the first positioning device 610 approaches one of the two second positioning devices 620*a* or 620*b*, whereby the rotary connection tube 300C is brought into the first position of use. If the rotary connection tube 300C is located in the second position of use, then the first positioning device 610 approaches the other of the two second positioning devices 620*a* or 620*b*, whereby the rotary connection tube 300C is brought into the second position of use.

Figure 14:
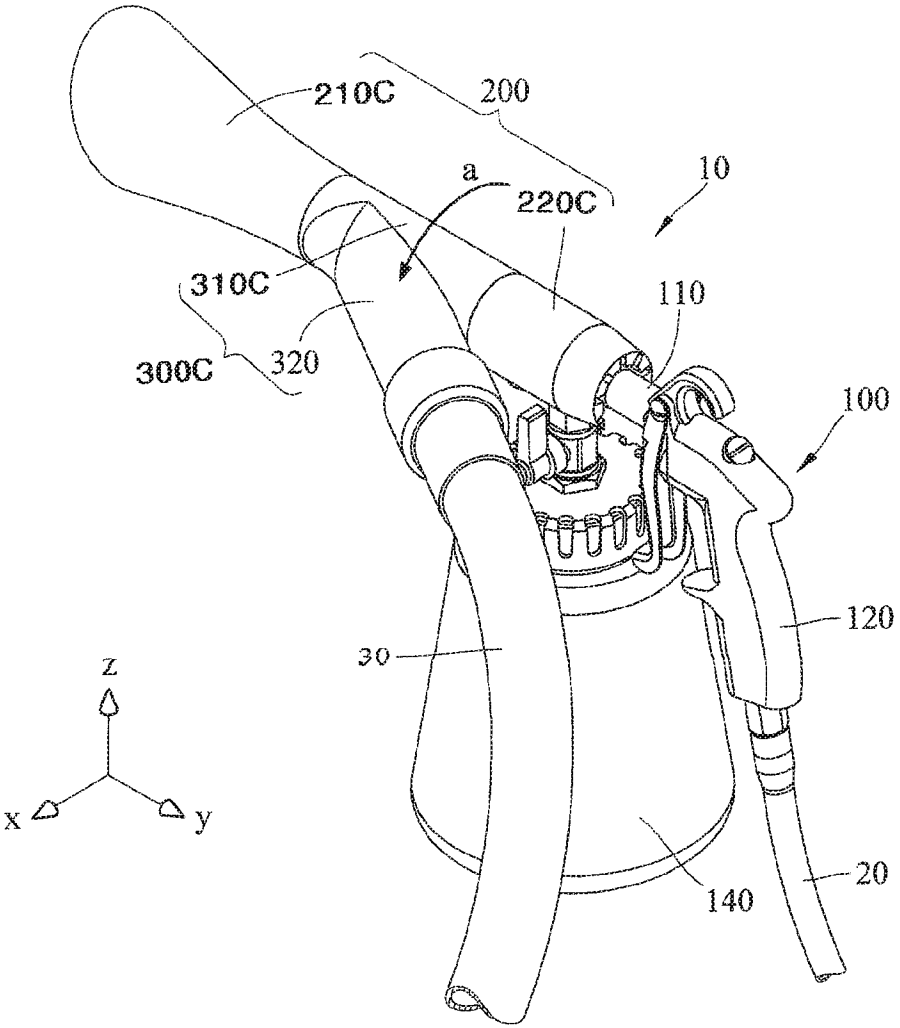
FIGS. 14 and 15: is a view of the positions of use of the pneumatic cleaning gun from FIG. 9.
Figure 15:
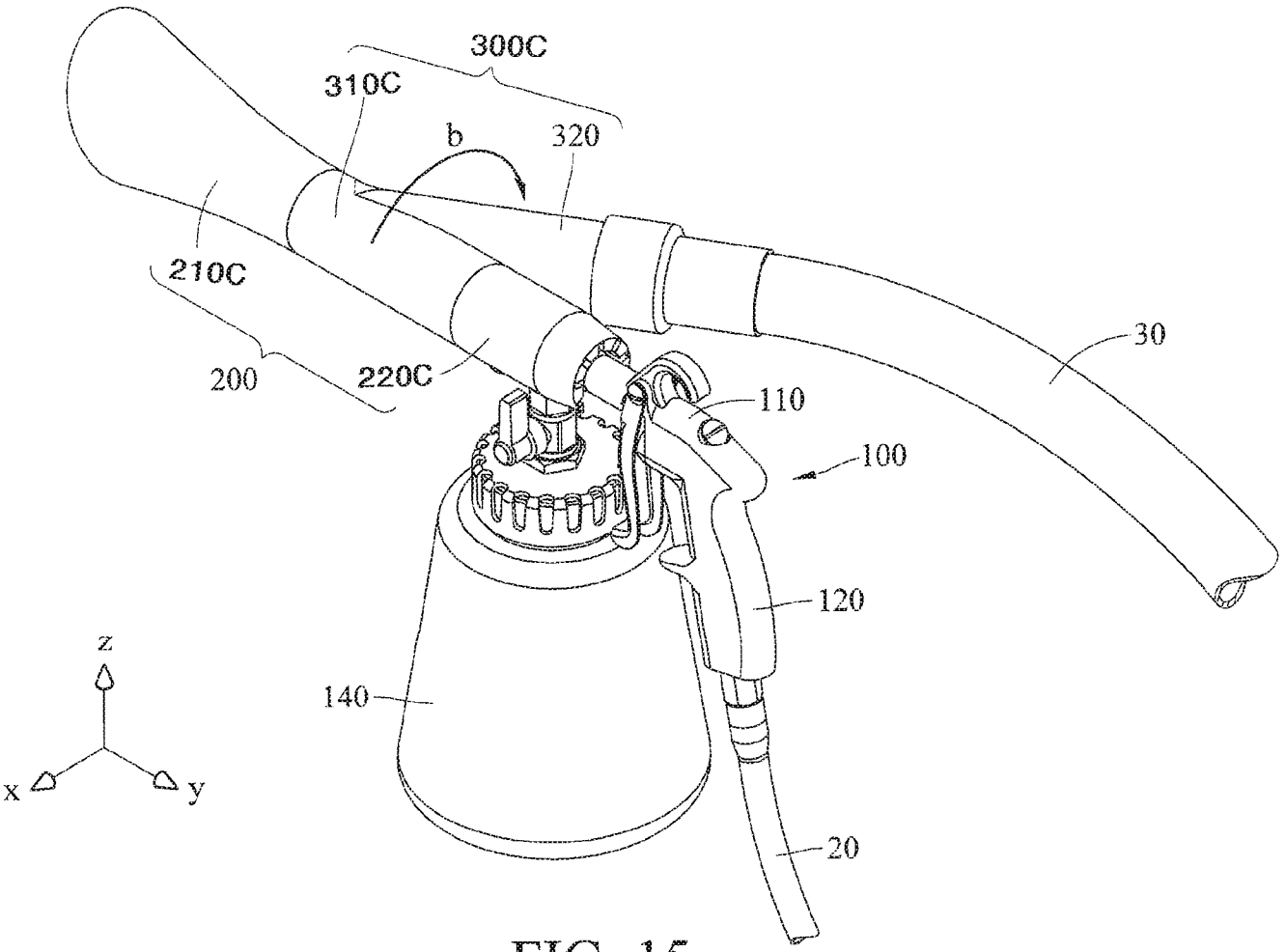

See FIGS. 14 and 15. FIGS. 14 and 15 are views of the use of the pneumatic cleaning gun from FIG. 9.

If right-handed, the user usually grips the hand grip 120 of the gun housing 100 with the right hand. If, therefore, the user wants to attach the air intake hose 30 to the air intake opening 321 of the branch tube 320, then the user can (as illustrated in FIG. 14) rotate the branch tube 320 in the direction of the arrow a to the left side of the gun housing 100, in order to plug the air intake hose 30 directly into the branch tube 320 with the left hand.

If left-handed, however, then the user can—as illustrated in FIG. 15—rotate the branch tube 320 in the direction of the arrow b to the right side of the gun housing 100, in order to plug the air intake hose 30 directly into the branch tube 320 with the right hand.

The actions described above make it clear that the rotary connection tube 300C that can be rotated relative to makes it possible to attach the external air intake hose 30 in the position of the rotary connection tube 300C that is preferred by the user, whereby the mounting of the cleaning gun 10 with external connecting hoses becomes more practical.

It should be noted that in the embodiment above, there are two openings, so that the air intake opening 321 of the branch tube 320 may be employed on the first opening 240 or on the second opening 250. The settings are not limited thereto, however, but rather the number of openings may in other embodiments (not set forth here) also be a single one, wherein the single opening extends from one side of the cover cavity 230 to the other side. If the rotary connection tube 300C is located in the first position of use, then the air intake opening 321 lies opposite one end of the single opening. If the rotary connection tube 300C is located in the second position of use, then the air intake opening 321 lies opposite the other end of the single opening. In addition, the above description covers only two positions of use of the rotary connection tube 300C. The positions are not limited to these two, however, and the rotary connection tube 300C may in other embodiments also have three or more positions of use (for example, another position of use with an upwardly-oriented air intake opening 321).

Moreover, in the above-mentioned embodiment, wherein the rotary connection tube 300C rotates relative to the gun housing 100, the nozzle cover 200 is rigidly fastened to the gun housing 100, and the rotary connection tube 300C rotates relative to the nozzle cover 200. There is no limitation to this shape, however, and in other embodiments in which the rotary connection tube 300C rotates relative to the gun housing 100, the nozzle cover 200 may also rotate relative to the gun housing 100, wherein the rotary connection tube 300C is rigidly fastened to the nozzle cover 200.

Figure 16:
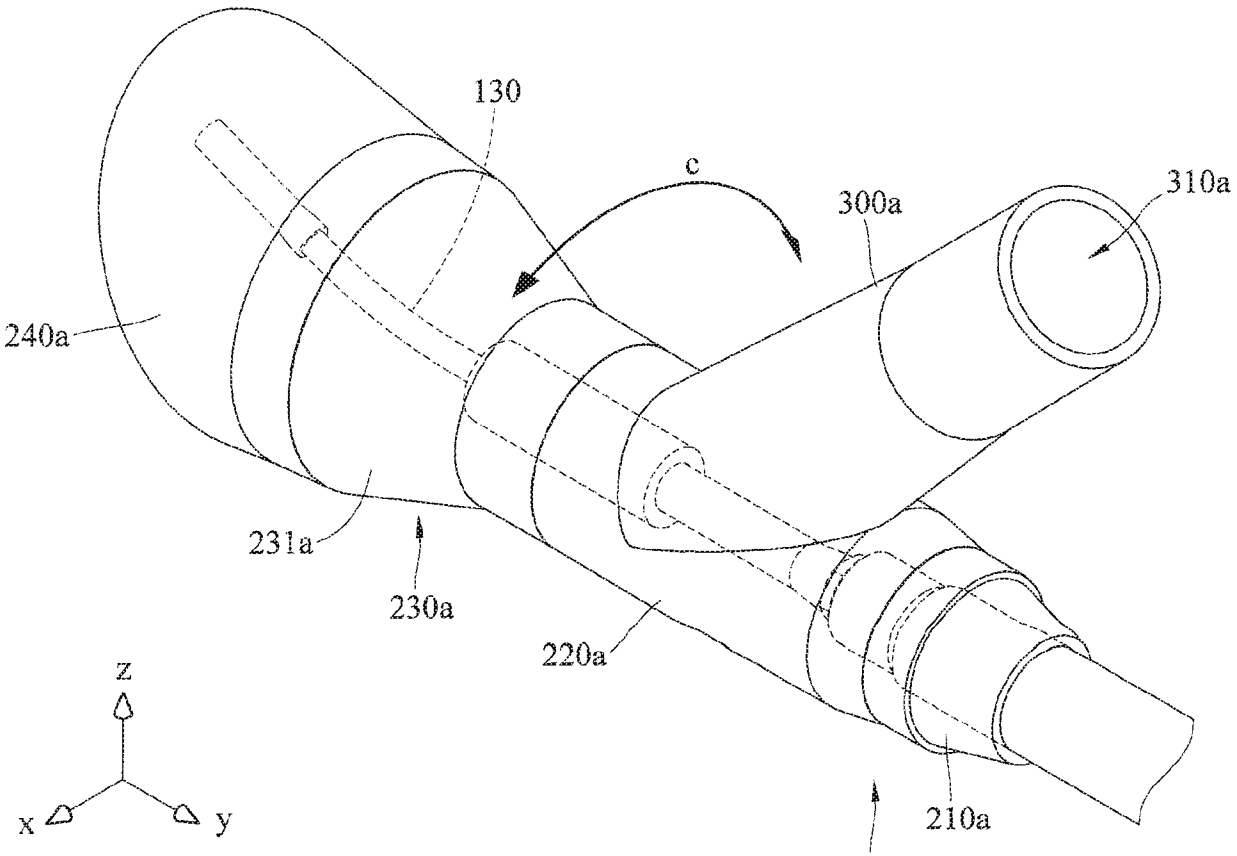
FIG. 16: is a three-dimensional view of a segment showing how the nozzle cover is attached to the gun housing, such as is illustrated in the second embodiment of this invention.
Figure 17:
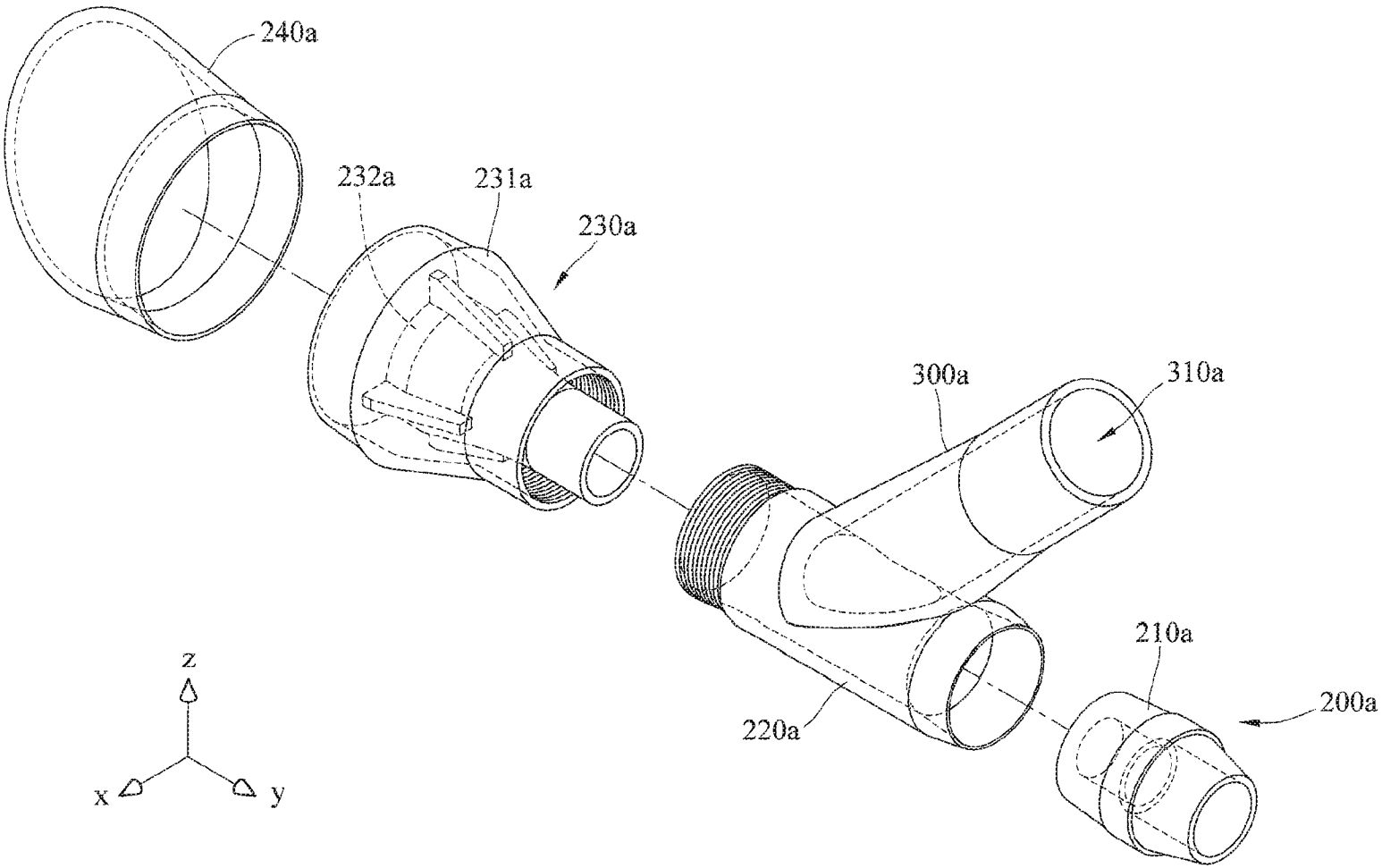
FIG. 17: shows a detail of the nozzle cover from FIG. 16.
Figure 18:
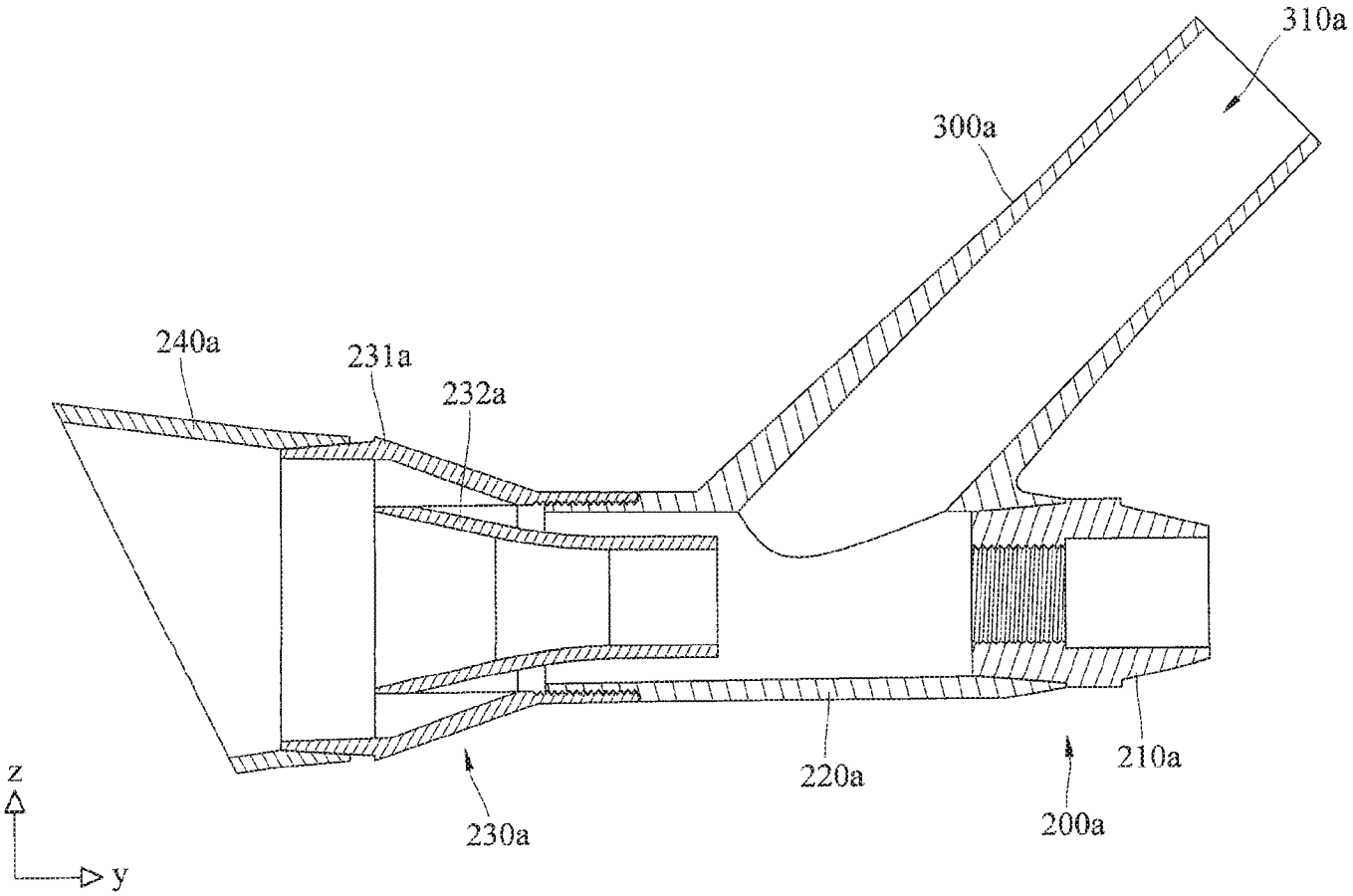
FIG. 18: is a sectional view of FIG. 16.

The structure of the aforementioned nozzle cover 200 is explained only by way of example, and is not limited to this shape. See FIGS. 16 and 17. FIG. 16 is a three-dimensional view of a section for how the nozzle cover is attached to the gun housing, such as is illustrated in the second embodiment of this invention. FIG. 17 a detail view of the nozzle cover from FIG. 16.

The nozzle cover 200*a* from this embodiment comprises a mounting sleeve 210*a*, a joint sleeve 220*a*, a flow disruption sleeve 230*a*, and a deflection sleeve 240*a*. The mounting sleeve 210*a* covers the liquid nozzle 130, wherein the end is attached to the gun body 110 of the gun housing 100. The joint sleeve 220*a* covers the liquid nozzle 130, and can moreover be attached in a rotating manner to the opposite end of the assembled sleeve 210*a*. In this embodiment, the fact that the outer surface of the mounting sleeve 210*a* is constructed as an annular conical surface allows the joint sleeve 220*a* and the mounting sleeve 210*a* to rotate about each other. In this case, the farther the annular conical surface is removed from the gun body, the smaller the diameter thereof. If the joint sleeve 220*a* moves close towards the mounting sleeve and presses on the annular conical surface, then the joint sleeve 220*a* is fastened to the mounting sleeve 210*a*. If the joint sleeve 220*a* moves in the direction away from the mounting sleeve 210*a* and then leaves the annular conical surface, then the joint sleeve 220*a* can rotate along the arrow c relative to the mounting sleeve 210*a*.

The flow disruption sleeve 230*a* comprises an outer ring 231*a* and an inner ring 232*a* that are interconnected. The outer ring 231*a* surrounds the inner ring 232*a* and is attached to the end of the joint sleeve 220*a* that faces away from the mounting sleeve. There is, however, no limitation to this form, and in other embodiments the outer ring 231*a* and the joint sleeve 220*a* may be fastened to each other by bonding, or the outer ring 231*a* and the joint sleeve 220*a* may be directly formed and constructed as one body.

The deflection sleeve 240*a* is removably attached to the end of the nozzle cover 230*a* that faces away from the joint sleeve 220*a*. It should be kept in mind that the deflection sleeve 240*a* and the nozzle cover 230*a* may also be shaped and constructed as one body.

One end of the rotary connection tube 300*a* has an air intake opening 310*a*, and the other end of the rotary connection tube 300*a* is connected to the joint sleeve 220*a*, so that the rotary connection tube 300*a* can rotate through the joint sleeve 220*a* along the direction indicated by the arrow c relative to the gun housing. It is therefore also possible in this embodiment, by means of the rotary connection tube 300*a* that can be rotated relative to, to rotate the rotary connection tube 300*a* to the position preferred by the user in order to install the external connecting hose. This makes it more practical to mount the outer connecting hose onto the pneumatic cleaning gun.

It should be noted that, in this embodiment, the inner ring 232*a* of the deflection sleeve 230*a* is rigidly fastened in the interior of the outer ring 231*a*. There is, however, no limitation to this form, but rather in other embodiments the inner ring 232*a* of the deflection sleeve 230*a* may also be attached in a rotatable manner in the interior of the outer ring 231*a*.

With the pneumatic cleaning gun according to the above embodiment, by means of the rotary connection tube that can be rotated relative to, it is possible to rotate the rotary connection tube 300*a* to the position preferred by the user in order to install the external connecting hose. This makes it more practical to join the external connecting hose together with the rotatable pneumatic spray cleaning gun.

Although the present invention discloses the aforementioned embodiment as a relatively good one, the invention is not limited to this example. Anyone who is familiar with similar technology can make some necessary changes and adaptations without departing from the sense and scope of this invention. Therefore, in the scope of the invention protected by the patent, the limitation of the requested patent scope from what follows these explanations must be considered as standard.

LIST OF REFERENCE SIGNS

10 Pneumatic cleaning gun
20 Compressed air line
30 Air intake hose
100 Gun housing
110 Gun body
120 Hand grip
130 Liquid nozzle
140 Liquid container
150 Air channel
160 Liquid hose
161 Liquid inlet
162 Liquid outlet
200 Nozzle cover
200*a* Nozzle cover
210 Mounting sleeve
210*a* Mounting sleeve
210C Main body
211 Inner mounting ring
211C Inner surface
212 Outer mounting ring
212C Outer surface
212A Outer surface
212B First positioning structure
213 Hollow
220 Cover sleeve
220*a* Joint sleeve
220C Annular seat
221 Inner side
221A Covered flow channel
222 Second positioning structure
223 Engaging groove
230 Cover cavity
230*a* Flow disruption sleeve
231*a* Outer ring
232*a* Inner ring
240 First opening
240*a* Deflection sleeve
250 Second opening
260 Annular sliding groove
300 Air intake tube
300*a* Rotary connection tube
300C Rotary connection tube
310 Air intake opening
310*a* Air intake opening
310C Plug-in connection ring
320 Branch tube
321 Air intake opening
400 Flow disruption ring
400C Fixing piece
410 Ring
420 Flow disruption plates
500 Deflection ring
610 First positioning device
620*a* Second positioning devices
620*b* Second positioning devices

What is claimed is:

1. A pneumatic cleaning gun comprising the following:

a gun housing that comprises a gun body and a liquid nozzle, wherein the liquid nozzle is connected to the gun body;

a nozzle cover that comprises a mounting sleeve and a cover sleeve , wherein the mounting sleeve is attached to the gun body of the gun housing, and the cover sleeve is attached to the mounting sleeve in one of a plurality of positions and surrounds a covered flow channel, wherein the liquid nozzle is located in an interior of the covered flow channel of the cover sleeve;

a flow disruption ring that is attached to the cover sleeve and is located in the covered flow channel; and an air intake tube that is rigidly connected to the cover sleeve, wherein the air intake tube has an air intake opening and the air intake opening leads into the covered flow channel, wherein the mounting sleeve has a plurality of first positioning structures, the cover sleeve has at least one second positioning structure, the second positioning structure is configured to be engaged with any one of the first positioning structures, so that the air intake tube has the plurality of positions of use;

wherein the first positioning structures are located on an outer side of the mounting sleeve, and the second positioning structures are located on an inner side of the cover sleeve, the at least one second positioning structure is a plurality of positioning structures, each of the first positioning structures constitutes a raised rib and the second positioning structure constitutes a concave groove, a height of each raised rib gradually decreases from a side that faces the gun body to the side that faces away from the gun body.

2. The pneumatic cleaning gun according to claim 1, characterised in that the flow disruption ring comprises a ring and a plurality of flow disruption plates, the ring and the cover sleeve are separated from each other, and the flow disruption plates extend beyond the ring and are located between the ring and the cover sleeve.

3. The pneumatic cleaning gun according to claim 2, characterised in that the inner side of the cover sleeve has a plurality of engaging grooves, and the flow disruption plates each engage with these engaging grooves.

4. The pneumatic cleaning gun according to claim 3, characterised in that said gun further comprises a deflection ring that is removably attached to an end of the cover sleeve that faces away from the mounting sleeve.

5. A pneumatic cleaning gun comprising:

a gun housing comprising a gun body, a hand grip, and a liquid nozzle, the hand grip and the liquid nozzle each being connected to one of two opposite sides of the gun body;

a nozzle cover that is attached to the gun body of the gun housing, the nozzle cover surrounding a cover cavity and the liquid nozzle being located in an interior of the cover cavity of the nozzle cover; and a rotary connection tube that is connected to the nozzle cover, the rotary connection tube having an air intake opening and the air intake opening leading into the cover cavity, the rotary connection tube being rotatable relative to the gun housing and having at least one first position of use and one second position of use, wherein the rotary connection tube comprises a plug-in connection ring and a branch tube, the plug-in connection ring is configured to be drawn in a rotating manner over the nozzle cover, the branch tube is configured to be connected to the plug-in connection ring, and the air intake opening is configured to be located at an end of the branch tube that faces away from the plug-in connection ring; and wherein the nozzle cover has a first opening and a second opening in the two opposite sides of the cover cavity, the air intake opening of the branch tube leading through the first opening or through the second opening into the cover cavity, the air intake opening corresponding to the first opening if the rotary connection tube is located in the first position of use, the air intake opening communicating with the second opening if the rotary connection tube is located in the second position of use.

6. The pneumatic cleaning gun according to claim 5, characterised in that the nozzle cover has an opening in one side of the cover cavity, the air intake opening of the branch tube leading through this opening into the cover cavity, the air intake opening corresponding to one end of the opening if the rotary connection tube is located in the first position of use, the air intake opening corresponding to the other end of the opening if the rotary connection tube is located in the second position of use.

7. The pneumatic cleaning gun according to claim 6, characterised in that the nozzle cover comprises a main body and an annular seat , the main body having an inner surface and an outer surface opposite each other, the inner surface covering the cover cavity, one end of the main body having an inwardly-recessed hollow of the outer surface, the annular seat being drawn over the hollow of the main body and the main body forming, together with the annular seat, an annular sliding groove, the plug-in connection ring being located on the annular sliding groove.

8. The pneumatic cleaning gun according to claim 7, wherein, when the rotary connection tube is located in a first position of use, a first positioning device engages one of two second positioning devices, and when the rotary connection tube is located in a second position of use, the first positioning device engages another of the two second positioning devices.

9. The pneumatic cleaning gun according to claim 8, characterised by a fixing piece that is attached through the annular seat and is pressed against the gun body in order to fix the annular seat on the gun body.

* * * * *